United States Patent [19]

Evans et al.

[11] Patent Number: 4,561,790

[45] Date of Patent: Dec. 31, 1985

[54] WIRE MATRIX PRINT HEAD APPARATUS

[75] Inventors: Vaughn R. Evans, West Lebanon, N.H.; Richard H. Harris; Allan C. Thorpe, both of Raleigh, N.C.; John E. Watts, Cary, N.C.

[73] Assignee: International Business Machines Corporation, Armonk, N.Y.

[21] Appl. No.: 695,339

[22] Filed: Jan. 28, 1985

[51] Int. Cl.[4] ..... B41J 3/12

[52] U.S. Cl. ..... 400/124; 101/93.05

[58] Field of Search ..... 400/124; 101/93.05; 335/271, 274, 278

[56] References Cited

U.S. PATENT DOCUMENTS

| | | | |
|---|---|---|---|
| 3,770,092 | 11/1973 | Grim | 400/124 |
| 3,828,908 | 8/1974 | Schneider | 400/124 |
| 3,893,220 | 7/1975 | Bittner | 400/124 X |
| 3,896,918 | 7/1975 | Schneider | 101/93.05 X |
| 3,929,214 | 12/1975 | Hebert | 400/124 |
| 4,009,772 | 3/1977 | Glaser et al. | 400/124 |
| 4,375,338 | 3/1983 | Mitsuishi | 101/93.05 X |
| 4,401,392 | 8/1983 | Blomquist et al. | 400/124 |

*Primary Examiner*—Paul T. Sewell

[57] ABSTRACT

The invention is a magnetically actuated clapper-style armature wire matrix print head. A light weight highly reliable and low cost design is achieved by utilizing single molded parts wherever possible. A unitary molded straight line channel wire matrix wire guide is molded as a single part. The flux return member is a single formed part with attached magnetic cores. The magnetic cores have thermal contact with an attached or integral heat sink that extend from the flux return member in the axial direction with the cores and which may be integrated with the support frame for the print head structure. A rebound absorbing backstop member receives the armatures on the rebound but also serves as a means of maintaining pivotal contact between the end of the armatures and the top edge of the flux return member so that a continuous flux path from the flux return member, through the armature and down through the cores of the electromagnets can be attained.

4 Claims, 10 Drawing Figures

25
26
27
28
29
30
31
32
33
34
35
36
37
38
39
40
41
42
43

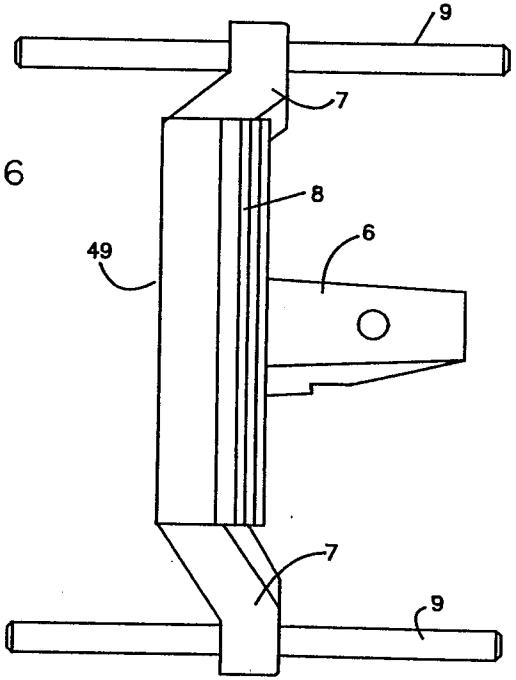
FIG. 6
FIG. 3
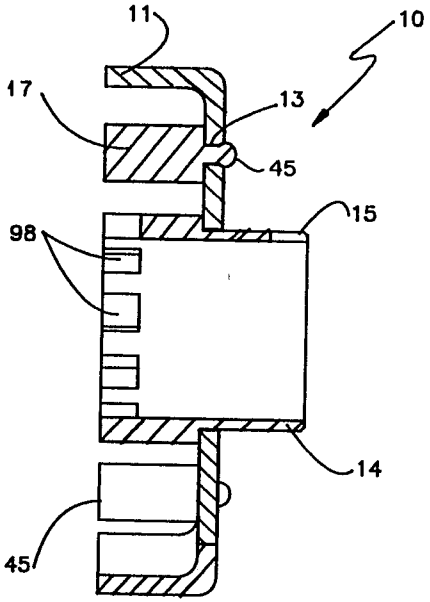

WIRE MATRIX PRINT HEAD APPARATUS

FIELD OF THE INVENTION

This invention relates to impact printers in general and to wire matrix or dot matrix wire printers in particular.

PRIOR ART

A great number of wire matrix print heads exist in the known prior art. For example, U.S. Pat. No. 3,770,092 shows a print head in which a monolithic heat sink has the armatures inserted in it together with what appears to be a straight line wire guide. However, the expense of forming a monolithic block of metal into such a form is considerable. In addition, the mass of the system is unnecessarily increased.

U.S. Pat. No. 3,828,908 shows an alternative wire matrix print head in which E-shaped cross section electromagnetic paths exist with the core on the center leg of the E shape. A curvature exists in the print wire which must be threaded through multiple guides in a hollow tube. This substantially increases the difficulty of assembly in manufacture since the threading of the wires through the guides is not an easy task. In addition, the monolithic nature of the heavy metal electromagnet structure, which utilizes integral concentric cups with a common bottom wall to form the inner and outer legs of the E which are conjoined with the electromagnetic core to form the center legs, creates a costly and massive structure that is difficult to manufacture.

U.S. Pat. No. 4,009,772 is another such example in which an E-shaped electromagnetic core and flux path exists. Also the wires are housed in a hollow tube with guides and are caused to follow a slightly curved path which makes assembly and threading of the wires a difficult operation. The complex structure required to provide a backstop and shock absorber and still maintain the ends of the armatures in contact with the top of the E-shaped flux return portion add numerous parts and further increase the difficulty of manufacture.

U.S. Pat. No. 3,929,214 is a typical example of the built up head in which a markedly curved wire path with numerous wire guides is used. Individual core structures are mounted on a base plate and individual flux return path members are attached thereto. A back cover with separate shock absorbing means and a special force applying spring section is utilized to provide a cantilevered return force to return the armatures from the impact position. The lack of a true straight line wire guide in which the wires follow straight paths combined with the necessity of assembling numerous individual pieces and adjusting each for the appropriate gap and rebound characteristics greatly increase the cost and difficulty of manufacture as will be appreciated by those of skill in the art.

U.S. Pat. No. 3,893,220 shows an approach to manufacturing such a print head in which a unitary molded wire guide exists, but the wires are forced to follow curved channels which greatly increases the problem of molding such an element. The unitary molded structure is, however, greatly superior to the structures in which the wires must be curved through individual wire guides spaced along the length of the wire as in the other prior art mentioned above. Nevertheless, the expense and difficulty of making integrally molded curved channels for the wires together with the complex cantilevered support structure for the spring armatures or hammers that drive the wires increase the cost and difficulty of manufacture to an unacceptable degree.

OBJECTS OF THE INVENTION

In view of the known shortcomings with the prior art such as that described above, it is an object of the present invention to provide an improved wire matrix print head apparatus in which true straight line paths for the wire print needles are attained while still allowing a compact structure to be built.

Yet another object of the present invention is to provide a wire matrix print head with improved cooling in a compact and unitary design in which heat sink elements with finned convectors may be incorporated directly with the electromagnetic cores.

Yet another object of the present invention is to provide an improved wire matrix print head in which the rebound absorbing member can provide the dual functions of seating the armatures against the flux return member to close the flux path while, absorbing armature rebound forces in a simple, easily manufactured structure.

These and yet other objects of the invention which have not been specifically enumerated are met in the improved embodiment of the invention as is now briefly summarized.

SUMMARY

The foregoing and other objects of the invention not specifically described are met in the present invention by providing a unitary molded straight line wire guide with straight convergent channels therein. The channels are arranged in the plan of a circle at the input end where the ends of the wire matrix wires are impacted by the armatures or print hammers. The wire channels converge to a straight output line, or two parallel output lines, so that no curvature or bending of the wires is encountered. This approach greatly enhances the life of the print wire since no flexing is involved. It also greatly simplifies the molding of the wire guide and the eventual assembly of the print head.

In addition, a unitary molded flux return member formed of magnetically permeable material is made with castellated or crenellated edges. The flux return member is essentially in the form of a single-walled cup having a bottom and generally circular peripheral side wall upstanding therefrom. Notches in the side wall separate the side wall into castellations.

On top of each castellation, a print hammer or armature is pivotally mounted to extend inwardly from the edge of the castellated wall toward the central portion of the print head. The flux return member has mounted on it, in a circular array on its bottom surface, a plurality of electromagnetic cores with appropriate windings. Each core, together with the bottom of the cup and side wall of the cup and the armature form a closed flux path. The armature reaches across the top of the generally U-shaped or C-shaped yoke or flux path structure.

The armatures are retained in place by light contact from the peripheral edge of a rubber rebound absorber of high damping characteristics. A back cover and fastener pass through central apertures in the impact absorber. The fastener is received in a hole in the end of the unitary wire matrix wire guide so that only a single fastener is utilized in the entire assembly.

All of the air gaps in the working armatures are established by grinding the ends of the flux return members flush with a central sleeve inserted through a central aperture in the bottom wall of the flux return cup member. The opposite end of the sleeve is also ground flush to a specific dimension to limit the insertion of the wire guide member to a prescribed depth. This establishes the end plane at which the wires will emerge in a circular array to confront the ends of the individual magnetic armatures. Merely screwing the fastener in place will lightly sandwich the ends of the armatures against the top of the flux return member wall castellations and maintain the flux path continuity that is required.

No air gap adjustments other than this are necessary since each of the individual wire matrix wires is spring loaded by a compression spring to return outward, pushing against the armature and raising it off of the electromagnetic core to force the tip of the armature against the rebound absorber held in place by the back cover. This simple structure provides great uniformity in flight times and impact forces as will be appreciated by those of skill in the art. Although the wires may be of slightly different length due to the slight differences in the length of the straight incline paths, they may be simultaneously activated and then ground to a flush plane upon assembly as will be instantly appreciated.

The invention will be described in greater detail with reference to a preferred embodiment that is illustrated in the drawing as follows.

BRIEF DESCRIPTION OF THE DRAWINGS

The invention is depicted in the attached drawings in which:

FIG. 3 illustrates the yoke assembly as shown in FIG. 2 and shows how the central sleeve through the bottom wall is employed.

FIG. 6 illustrates the frame assembly with an integral heat sink that contacts the ends of the electromagnetic cores as shown in FIG. 1.

DETAILED SPECIFICATION

Figures 1, 1A, 1B:
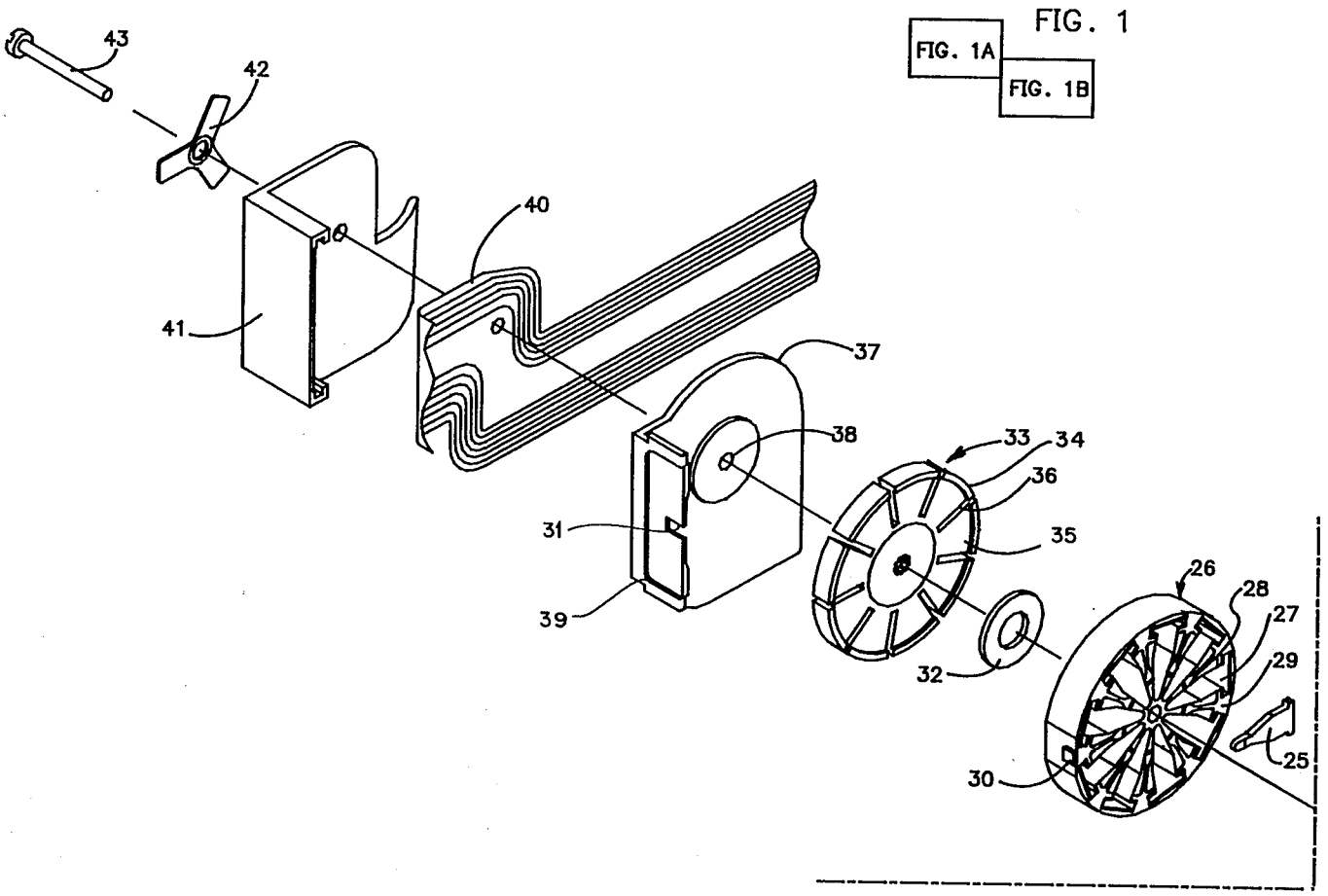
FIGS. 1, 1A and 1B illustrate an exploded pictorial view of the overall print head assembly.

Turning to FIG. 1, an exploded view of the components comprising a preferred embodiment of the present wire matrix print head invention is depicted. The molded unitary wire guide 1 is made of plastic, preferably modified or glassfilled polyesters or polysulfone such as are well known in the industry for structural engineering parts. The wire guide 1 includes an input end 2 and an output end 3. It may be observed that at the output end, the emerging wire holes are in one or more parallel straight rows. At the input end 2, though not visible in FIG. 1, the wires are arranged in a circular pattern. A shoulder 4 integrally molded on wire guide 1 limits the depth of insertion into the hollow sleeve member 14 in its central aperture. A lug molded on the side wall of the wire guide 1, which is not visible in FIG. 1, fits in the groove 44 in the opening of the sleeve 14 member.

The frame member and heat sink 8 is a unitary piece comprising the heat sink fin elements 8, integral rigid arms 7 and support rods 9. The basic frame body 6 is arranged to make thermal contact with the ends 45 of the cores 17 where they emerge through holes 13 in the flux return member 10.

Flux return member 10 is formed of silicon iron to provide high magnetic permeability and is provided in a crenellated or castellated form with individual castellations 11 separated from one another by spaces 12 as shown. The holes 13 permit the base ends of the magnetic cores 17 to protrude for hot upsetting to lock the cores firmly and in tight magnetic flux path coupling with the flux return member 10. The ends of these cores though not shown in FIG. 1, may be ground flush with the bottom surface of flux return member 10 so that a tight thermal joint between this member and the heat sink element member body 6 can be achieved.

A hollow sleeve 14 having a notch 15 is inserted axially through a central aperture in the flux return member and is brazed or silver soldered in place. This is a non-magnetic sleeve that is ground to a specific dimension between its ends as will be described later which sets exact tolerances for the assembly of the parts. The end surface of sleeve 14 is received within the aperture 5 of the frame element 6. The notch 15 in sleeve 14 receives a molded lug on the plastic molded wire guide 1 to orient it relative to the position of the crenellations in the flux return member. A shoulder on the wire guide limits the depth of insertion of the wire guide into the sleeve 14 to exactly register the input end of guide 2 at a specified height relative to the top edges of the flux return castellations 11.

A flexible circuit element bearing a plurality of wire matrix drive coils 17, each of which is to be fitted over a magnetic core member through a hole 45, is shown. The core members do not appear in this figure but are hot upset and affixed to the flux return member 10 as previously noted.

The flexible circuit element 18 has two rectangular apertures 19 that fit over individual castellations 11 of the flux return member 10 to precisely locate the windings 17 over the individual core members, not shown. A central aperture 20 permits the end 2 of the wire guide 1 to extend through the flexible circuit so that the ends 22 of wires 21 will lie in the vicinity of the end of each individual hammer armature 25 upon assembly. Springs 23 are the compression type and are received in small molded seats in the end 2 of the wire guide 1 to resiliently bias the wire 21 back away from the output end 3 of the wire guide 1 and against the ends of the print hammers or armatures 25, thus tending to force the armatures 25 away from the core or pole piece of the electromagnetic windings 17.

A residual magnetism interrupter 24 is a thin non-magnetic or dielectric plastic material stamped in the shape required to separate the armatures or hammers 25 from direct physical contact with the ends of the castellations 11 of the flux return member 10 or with the central electromagnetic cores of the windings 17. This prevents slight magnetism in the armatures or hammers 25 from retarding the return.

It will be understood that the hammers 25 are pivotally supported on the top edges of the castellations 11 and must be retained in place. A means for retaining the hammers will be described with reference also to the backstop element when it is described below. The hammers must also be laterally maintained as will now be described.

A retainer or housing 26 aids in providing this function. The retainer or housing 26 comprises a general peripheral wall 29 with a number of webbed fingers 28 joining in a central hub. The fingers 28 have generally radial apertures therebetween. The radial apertures denoted as 27 are in general form of the profiles of the hammer armatures 25. The hammer armatures 25 may be inserted in these apertures 27.

A thin plastic disk 32 is inserted into the reverse side of the retainer 26 and bears against the central portion of the rubber backstop shock absorber 33 to prevent galling or adhesion between the ends of the hammer armatures 25 and the backstop 33.

Backstop 33 comprises a unitary, molded, high damping coefficient rubber structure having a number of fingers 35 separated by slots 36 and having peripheral rims or edges 34 slightly upstanding therefrom. These rims or edges 34 are received in a groove in the backside of the retainer 26 where they bear against the ends of the hammer armatures 25 to maintain them lightly in contact with the top surface of the residual magnetism preventer 24. This also maintains a close magnetic coupling flux path with the top edges of the castellations 11 in the flux return member 10.

The damping rubber backstop member is held in place by a back cover 37 which has a central aperture 38 through which a fastener 43 can be inserted. The back cover 37 also has a molded portion that acts as a strain relief cable retainer. This portion is identified as the flange area 39 having a notch 31. The notch 31 registers with a molded lug 30 on the periphery of the retainer 26 as shown. This precisely locates the back cover 37 so that the flat wire cable 40 will be maintained in the proper position relative to the portion 18 thereof which joins to the flexible circuit which registers over the flux return member 10 by means of the rectangular apertures 19 as previously described.

The strain relief clamp member 41 is held in place by a load spring 42 and the fastener 43 which is inserted through the aligning set of apertures in the spring, strain relief, cable, back cover, shock absorbing backstop, disk, retainer, residual member, the center of the flexible circuit, the flux return member and finally into a threaded aperture in the center of the wire guide member 1. By this means only a single fastener 43 is necessary to assemble the entire wire matrix print head as illustrated in FIG. 1.

The springs 23 are of the helical compression type provide the only return forces to the print wires 21 and to the hammer armatures 25. A plastic ferrule tip 22 or head driving means is injection molded onto the end of each wire 21. The wires themselves are music wire or similar high tensile steel wires, although carbide-tipped or other hardened wires may be employed as desired.

The frame body 6 is die cast aluminum for high heat conductivity. The integral thin heat sink portion 8 may be made a part of the frame body 6 as in this embodiment. Another preferred embodiment utilizes a different form of frame member 6 and the heat sinks are actually integral with the ends of the cores of the electromagnets as will be described later.

The anti-residual magnetism member 24 is well known to those of skill in the art and prevents the magnetic reluctance path from getting too low and allowing the hammer member to become temporarily magnetized. This insures a quick hammer release once the coil current in the individual coil 17 is turned off and also improves wear at the hammer pivot point where it bears against the top surface of the castellations 11 in the flux return member 10.

The housing or retainer 26 is molded plastic and locates the hammer armatures 25 in their appropriate relationship. It also controls the air gap between the end of the hammer faces and the top of the electromagnetic cores in the electromagnet 17 by limiting the total displacement backward which can be imparted by the compression springs 23 forcing the ferrules 22 of the individual print wires 21 against the ends of the hammers 25. The backstop 33 is inserted in the back side of the housing or retainer 26 sandwiching the anti-galling disk 32 in the process.

The backstop 33 is molded of a high energy absorbing rubber such as NBR. This backstop absorbs the rebound energy of the hammer 25 after a dot is printed. The perimeter 34 has a rib as mentioned earlier that applies force to the end of the hammer armature 25 at the pivot point on the top of the castellations 11 of the flux return member 10. This force is only used to maintain a minimum air gap at the hammer pivot point and provides no return forces to the hammer.

The back cover 37 is injected molded plastic and serves to insulate the coil connections on circuit 18 from the flux return member 10 by the extension of the wall or flange portion 39 which will extend axially along the area where two or more of the castellations 11 are formed. The back cover also provides support for the flexible supply circuit cable 40 and compresses the rubber backstop 33 against the housing or retainer 26. The strain relief clamp 41 is also injection molded plastic and protects the flexible circuit element 40 by providing a nest with the flange portion 39 of the back cover 37 as illustrated. It may be understood that the flexible wire circuit 40 is sandwiched between the back cover 37 and the strain relief clamp 41 by means of the fastener 43 compressing the leaf spring 42 upon assembly. The compression spring provides resiliency to insure that the assembly remains tight even if the plastic parts tend to creep after assembly. Leaf spring 42 also limits the compressive forces in the assembly which provides for precise control of critical dimensions in the assembly.

Figures 1B, 2:
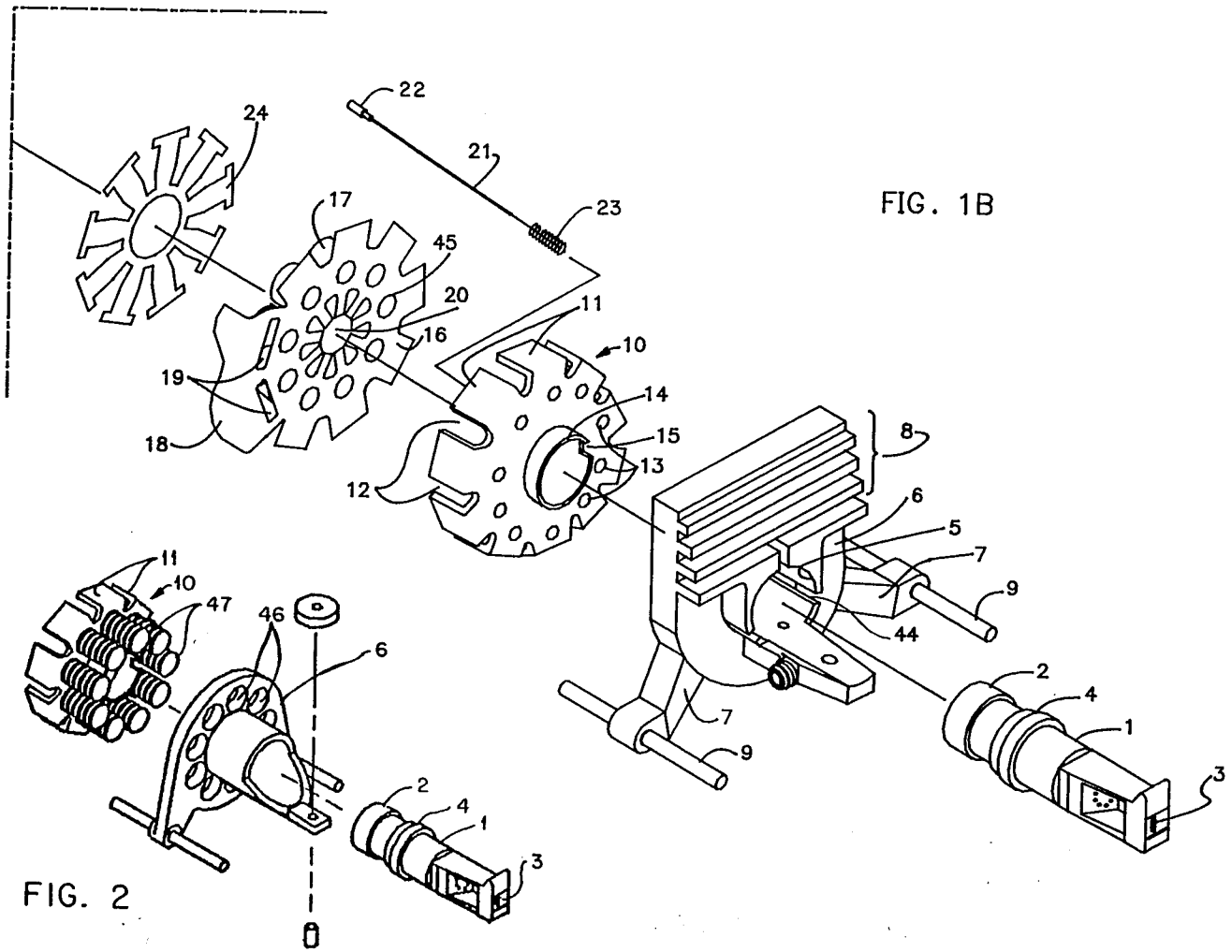
FIG. 2 illustrates an alternative yoke, heat sink and frame assembly that can be substituted for the yoke, heat sink and frame assembly members of FIG. 1 in an alternative improved embodiment of the invention.

FIG. 2 illustrates an alternative embodiment of the frame assembly and flux return member with an improved heat sink structure. In FIG. 2, the frame 6 is provided with a plurality of apertures 46 to receive the projecting finned heat sink elements 47 that extend axially from the ends of the electromagnet cores in the base of the flux return member 10. These heat sink elements may be actually integral with the cores to provide the highest degree of thermal continuity and provide the greatest desired cooling effect. The provision of individual finned heat sinks 47 for each core permits free flow of air through the cooling area and greatly enhances the capability of exhausting unwanted heat from the vicinity of the structure.

FIG. 3 illustrates in cross section the details of the flux return member 10, or the yoke assembly as it is sometimes called. It may be seen that the flux return member 10 is generally in the form of a flat bottomed cup having upstanding castellation leaves 11 and a central aperture in the bottom through which the sleeve 14 is inserted and brazed or soldered in place. The sleeve 14 has castellations of its own in the periphery as shown in 98 to permit the ends of the hammer armatures 25 not shown, to pass freely into the central section of the sleeve 14 and to keep the ends of the armatures or hammers from sliding sideways. The castellations are cut deep enough to prevent actual mechanical contact in the impact position of the hammers and it further is made of non-magnetic material to prevent residual magnetism problems in this area. It takes no part in the flux path and thereby provides for a more concentrated flux path between the core members 45 and the flux return castellations 11 in a general U-shape as shown. The individual core members 45 are made of silicon iron and are hot upset in apertures 13 located in a circular array in the bottom wall of the cup portion of the flux return member 10 as shown.

Figure 4:
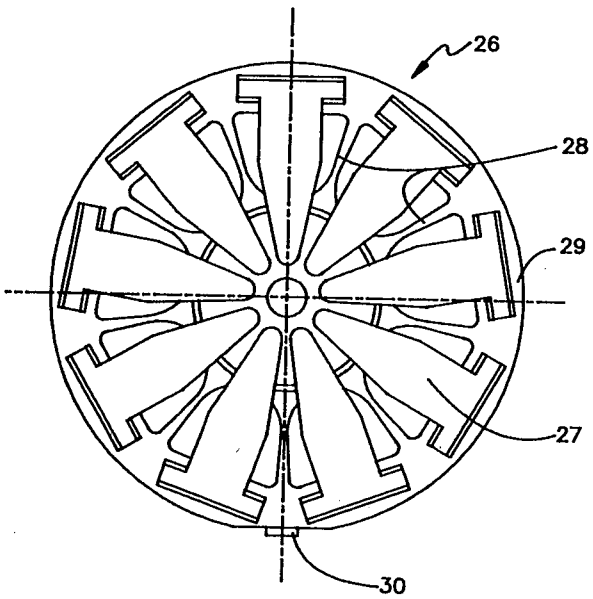
FIG. 4 illustrates the housing or retainer that holds the individual armatures and the rebound absorber in appropriate spacing and relationship to each other.

FIG. 4 illustrates in plan view the retainer or housing 26 in greater detail. It will be observed that a plurality of generally radial spokes 28 separate the hammer or armature shaped spaces 27. The spokes 28 join the peripheral rim 29 with a central hub as illustrated to provide a uniform and stable part. The molded lug 30 is utilized for registration with the back cover 37 through notch 31 as previously described with reference to FIG. 1.

The thickness of the web spokes 28 in the direction in and out of the plane of the drawing is precisely molded so that, when the individual hammer armatures 25 are inserted in the apertures 27, they will drop to a specified depth and lodge against the molded rubber backstop which is inserted from the backside as a retainer 26. The depth of the web sections 28 thus sets the total relative position of the entire nest of hammer armatures 25 relative to the top surface of sleeve 14 as shown in FIG. 3 and thereby sets the hammer flight distance for each of the hammers to be identical.

Figure 5:
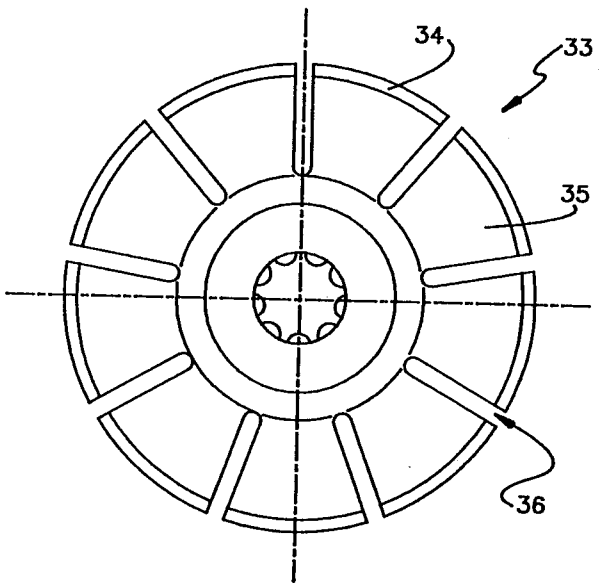
FIG. 5 illustrates the backstop or rebound absorber.

FIG. 5 illustrates in plan view a greater detail of the molded energy absorbing rubber backstop 33. The backstop 33 is a molded rubber part having a plurality of individual leaves or fingers 35 each with an upstanding ridge or peripheral ledge 34 as depicted. The ridge 34 is inserted in a groove in the backside of the retainer 26 to bear against the heel ends of the armatures or hammers 25. Backstop 33 has a hole or opening in the center to permit the passage of the fastener 43 therethrough.

FIG. 6 illustrates in greater detail a top elevation view of the frame member 6 having integral heat sink fins 8 as shown in the first embodiment of FIG. 1. The body 6 is joined by integral arms 7 to the support and guide rod 9 which allow insertion of the frame into the printer mechanism. The back surface 49 is ground flush for a tight thermal joint, preferably aided by thermally conductive grease or adhesives, with the end surface of the individual electromagnetic core members 45 and the end face of the flux return member 10 upon assembly.

Figure 7A:
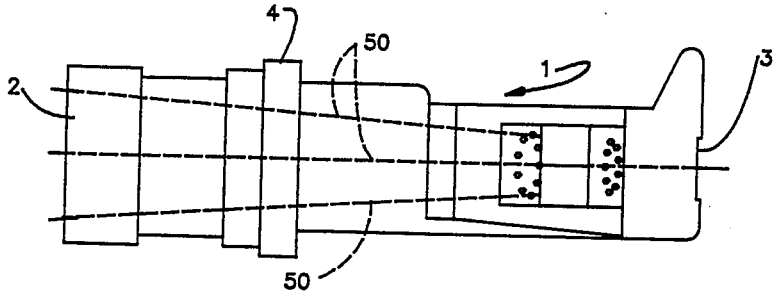
FIGS. 7A and 7B illustrate the wire guide with its straight line wire guiding channels as utilized in the invention.
Figure 7B:
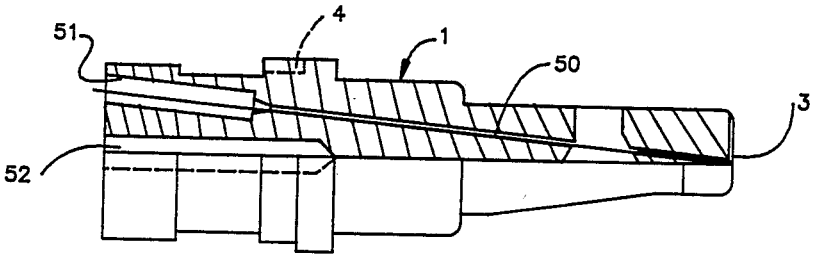

Turning to FIG. 7, a partially sectional view of the molded unitary wire guide 1 is illustrated. Individual straight channels 50 converge from the original input end 2 to the output surface 3 at opposite ends of the wire guide 1. Molded recesses or wells 51 receive the compression spring 23 referred to earlier. It may be observed that while the wire guide channels 50 are generally inclined, they are straight and impose no bending or flexural loads upon the wires when inserted therein. Also, easy insertion of the wires is greatly facilitated. A central bore 52 provides seating for the one fastener 43 referred to in FIG. 1 for joining the entire assembly as previously discussed.

Having thus described our invention with reference to preferred embodiments thereof, it will be apparent to those of skill in the art that some departures in form or structure may be made without altering the basic essence of the improvements presented.

Therefore, what is set forth in the following claims is intended by way of description and not by way of limitation wherefor what is claimed and desired to be protected by Letters Patent is:

1. An improved wire matrix print head, comprising:

a molded unitary wire guide having a plurality of straight channels for guiding print wires, said channels forming a circular array at one end of said guide and emerging as at least one straight line array at the other end of said guide;

a unitary magnetic flux return member formed as a castellated cup having an approximately circular castellated wall and a circular planar bottom surface with a central circular aperture therein;

a circular sleeve tube inserted in said circular aperture and extending axially therethrough towards the top of said flux return member and projecting axially outward from the bottom thereof, said wire guide being inserted into said sleeve tube and having an abutment molded thereon to limit the total depths of insertion therein;

a plurality of electromagnets comprising individual magnetic cores with windings thereon, said electromagnets being affixed to said flux return member with said cores forming a circular array concentric with said wall of said flux return member;

a plurality of magnetic armatures, each of said armatures being pivotally supported on the top of a section of the wall of said flux return member on a said castellated segment thereof and extending radially inward therefrom across a said core towards the center of said sleeve tube;

a plurality of print wires contained in said straight channels in said wire guide, said wires each having an enlarged head end means attached thereto at said end of said wire guide having said circular array, each said armature abutting an individual one of said head end means on a said wire; and a molded unitary backstop means overlying said armatures to absorb rebound energy therefrom; and a molded unitary armature retainer cage means for maintaining said backstop and said armatures in alignment with said head end means of said wires; and a back cover means, said back cover means adjoining said retainer means and abutting said backstop to maintain the edge thereof against the top of said armatures where they are supported on said castellated wall of said flux return member;

and a fastener means passing through said back cover in the center thereof and being received in the center of said unitary wire guide; and heat sink means in thermal contact with the ends of said cores where they join said flux return member for cooling said cores.

2. Apparatus as described in claim 1, wherein:

said heat sink means comprises an integral extension of each of said cores and each said extension is finned for improved heat transfer.

3. Apparatus as described in claim 1, wherein:

said heat sink means comprises a portion of a print head frame which holds said print head in position within a printing mechanism.

4. Apparatus as described in claims 1 or 2 or 3, wherein:

said backstop means is received in said retainer cage from one side and said armatures are received in said retainer cage from the other side, said armatures lying against said backstop and being held separate from one another by a plurality of molded spokes in said retainer means, said spokes joining a central hub and extending to a peripheral rim.

* * * * *